US005613365A

United States Patent [19]

Mastrup et al.

[11] Patent Number: 5,613,365

[45] Date of Patent: Mar. 25, 1997

[54] CONCENTRIC PULSE TUBE EXPANDER

[75] Inventors: Firithjof N. Mastrup, Rancho Palos Verdes; Steven C. Soloski, Manhattan Beach; Alan A. Rattray, Alta Loma, all of Calif.

[73] Assignee: Hughes Electronics, Los Angeles, Calif.

[21] Appl. No.: 353,609

[22] Filed: Dec. 12, 1994

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 4,711,650 | 12/1987 | Faria | 62/6 |
| 5,295,355 | 3/1994 | Zhou et al. | 62/6 |
| 5,303,555 | 4/1994 | Chrysler et al. | 62/6 |

FOREIGN PATENT DOCUMENTS

| | | |
|---|---|---|
| 614059 | 9/1994 | European Pat. Off. . |
| 4234678 | 4/1993 | Germany . |
| 1202203 | 8/1970 | United Kingdom . |

*Primary Examiner*—Ronald C. Capossela

*Attorney, Agent, or Firm*—Michael W. Sales; Wanda K. Denson-Low

[57] ABSTRACT

A pulse tube cooler comprising pulse tube, a regenerator concentrically disposed around the pulse tube, and a thermal insulator concentrically disposed between the pulse tube and the regenerator. More specifically, the concentric pulse tube cooler comprises a cold finger assembly disposed at a first end of the concentric pulse tube cooler, a heat exchanger assembly disposed at a second end of the concentric pulse tube cooler that is coupled to a a surge volume and that is coupled to a source of operating gas, and a pulse tube expander assembly slidably and sealably secured to the heat exchanger assembly. The pulse tube expander assembly comprises a central pulse tube, a thermal insulator concentrically disposed around the central pulse tube, and a regenerator concentrically disposed around the concentric insulation tube. The pulse tube expander assembly comprises a slidable axial seal for slidably and sealably securing the pulse tube expander assembly to the heat exchanger assembly. The seal permit relative axial motion between the cold finger and pulse tube expander assemblies and the heat exchanger assembly during cooling of the pulse tube cooler. Vacuum and solid insulation may be employed as the insulation tube.

24 Claims, 2 Drawing Sheets

CONCENTRIC PULSE TUBE EXPANDER

BACKGROUND

The present invention relates to pulse tube coolers, and more particularly, to an improved pulse tube cooler having a insulated concentric pulse tube expander.

A linear pulse tube cooler is arranged such that all components of its expander are disposed in a linear fashion. Consequently, two warm heat exchangers are disposed at opposite ends of the expander and a cold station is disposed in the middle. Packaging using linear pulse tubes is therefore awkward.

A concentric pulse tube cooler has one integrated warm heat exchanger disposed at one end of the expander, and a cold station is disposed at the opposite end of the expander in a conventional fashion. The concentric pulse tube expander is easier to package, install, use and is smaller than current linear pulse tube coolers.

Conventional concentric pulse tube expanders have not incorporated an insulator between the pulse tube and the regenerator. It was assumed that the temperature gradient and heat distribution in the pulse tube and the regenerator were similar.

SUMMARY OF THE INVENTION

However, contrary to the prior art, it was determined that the temperature distribution in the pulse tube and the regenerator were different. It was discovered that thermal communication between the pulse tube and the regenerator dramatically lowered the efficiency of the pulse tube cooler. The present invention addresses this problem.

Therefore, it is an objective of the present invention to provide for a pulse tube cooler that employs an improved concentric pulse tube expander having a thermal insulator that separates the pulse tube from the regenerator.

In order to meet the above and other objectives, the present invention is a pulse tube cooler comprising a pulse tube, a regenerator concentrically disposed around the pulse tube, and a thermal insulator concentrically disposed between the pulse tube and the regenerator. The thermal insulator may be formed using an insulating plastic material or a vacuum concentrically disposed between the pulse tube and the regenerator. More specifically the concentric pulse tube cooler comprises a cold finger assembly disposed at a first end of the concentric pulse tube cooler, a heat exchanger assembly disposed at a second end of the concentric pulse tube cooler that is coupled to a surge volume and that is coupled to a source of operating gas, and a pulse tube expander assembly slidably and sealably secured to the heat exchanger assembly. The pulse tube expander assembly comprises a central pulse tube, the thermal insulator concentrically disposed around the central pulse tube, and the regenerator concentrically disposed around the concentric insulation tube. The pulse tube expander assembly comprises a slidable axial seal for slidably and sealably securing the pulse tube expander assembly to the heat exchanger assembly. The seal permit relative axial motion between the cold finger and pulse tube expander assemblies and the heat exchanger assembly during cooling of the pulse tube cooler.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which.

DETAILED DESCRIPTION

Figure 1:
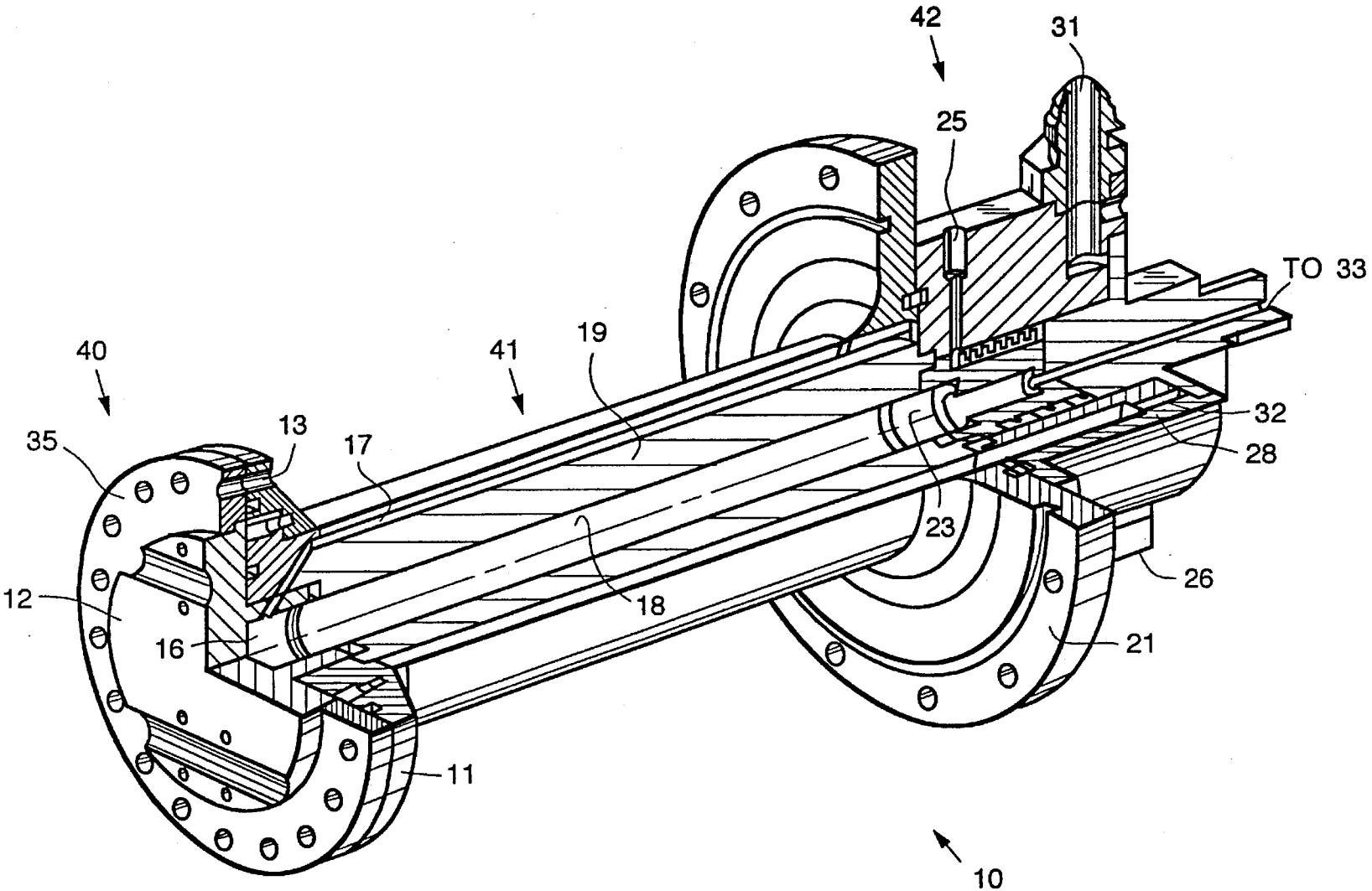
FIG. 1 illustrates a partially cutaway perspective view of a concentric pulse tube cooler in accordance with the principles of the present invention.
Figure 2:
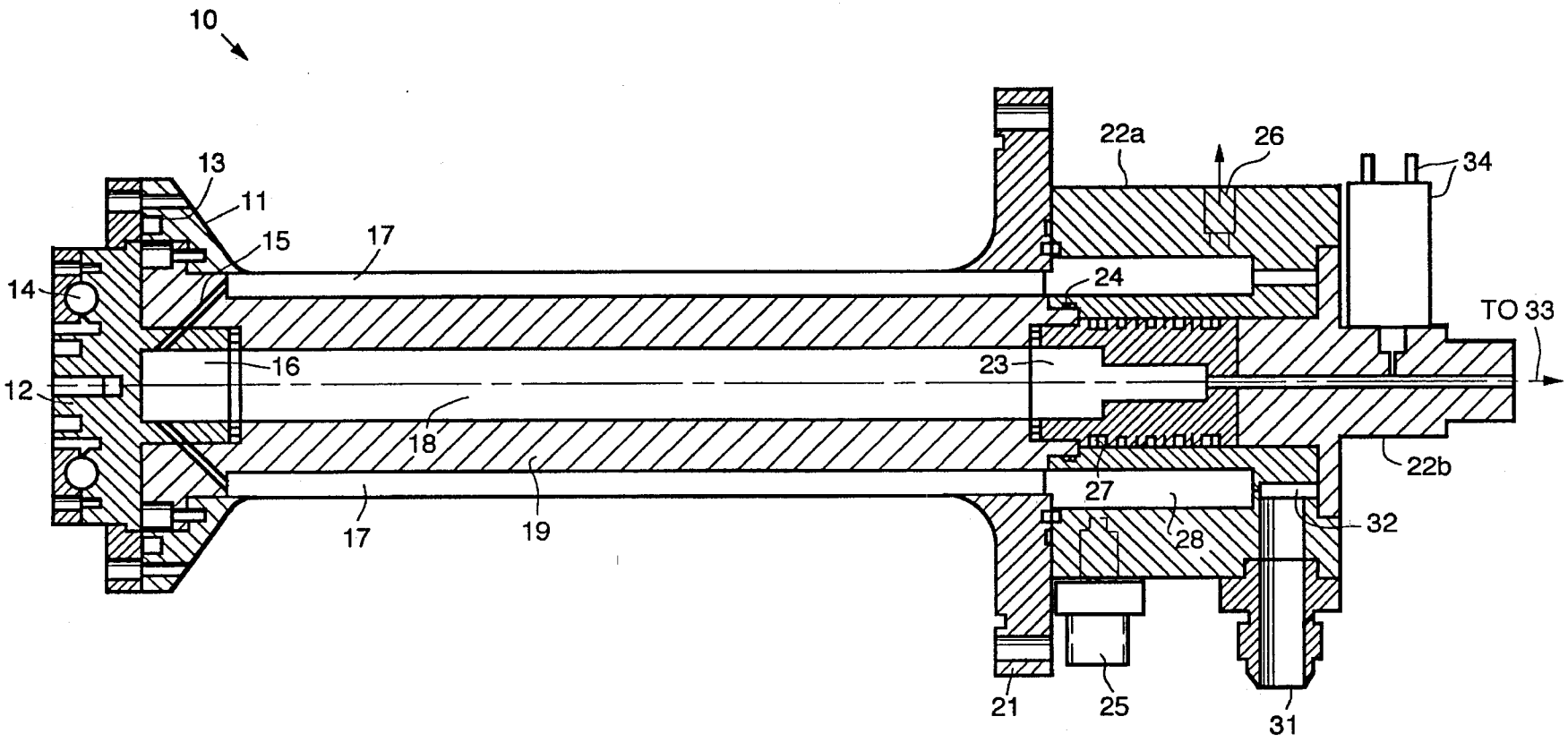
FIG. 2 illustrates an enlarged cross sectional view of the concentric pulse tube cooler of FIG. 1.

Referring to the drawing figures, FIG. 1 illustrates a partially cutaway perspective view of a concentric pulse tube cooler 10 in accordance with the principles of the present invention. FIG. 2 illustrates an enlarged cross sectional view of the concentric pulse tube cooler 10 shown in FIG. 1. The concentric pulse tube cooler 10 is comprised of three subassemblies including a cold finger assembly 40, a pulse tube expander assembly 41, and a dual heat exchanger assembly 42.

The cold finger assembly 40 is comprised of a cold finger 12 and a cold end heat exchanger 16 that is disposed in an axially extended portion of the cold finger 12. The cold finger 12 may be comprised of copper, for example. The cold end heat exchanger 16 may be comprised of 100 mesh copper screen, for example.

The pulse tube regenerator assembly 41 is comprised of a central pulse tube 18, surrounded by a concentric insulation tube 19 that is surrounded by a concentric regenerator 17. The concentric regenerator 17 may be comprised of 400 mesh CRES steel screen, for example. The central pulse tube 18, insulation tube 19 and regenerator 17 are secured in a housing 11. A plurality of cold finger coupling channels 15 are disposed through the insulation tube 19 and cold finger that couple the regenerator 17 to the cold end heat exchanger 16.

A flange 35 disposed at one end of the pulse tube expander assembly 41 adjacent the cold finger that is used to secure the cold finger assembly 40 to the housing 11 of the pulse tube expander assembly 41. A vacuum interface flange 21 is disposed at an opposite end of the pulse tube expander assembly 41 distal from the cold finger assembly 40 and adjacent the heat exchanger assembly 42 that is used to secure the concentric pulse tube expander assembly 41 to the heat exchanger assembly 42 and to a vacuum source (not shown) for a vacuum dewar that insulates the cold finger.

Thus, the concentric pulse tube expander assembly 41 has a thermal insulator comprising the concentric insulation tube 19 that separates the central pulse tube 18 from the concentric regenerator 17. This concentric arrangement has not been utilized in conventional pulse tube expanders 10.

The temperature gradient down the regenerator 17 does not match the temperature gradient down the pulse tube 18. Thus, there is heat flow that reduces the efficiency of the cooler 10. The present concentric insulation tube 19 (thermal insulator) reduces the heat flow and thus improves the efficiency of the cooler 10. The amount of loss, and therefore the type of insulator and amount of insulation, is affected by the aspect ratio of the expander assembly 41. The insulation tube 19 may be comprised of ULTEM or GTEM plastic, available from General Electric Company, Plastics Division, for example. Vacuum insulation, which provides a greater amount of insulation than plastic insulation, may be used as an alternative to the plastic insulation.

The pulse tube expander assembly 41 is slidably secured to the heat exchanger assembly 42 by means of a slidable axial seal 24 that is provided by a viton O-ring, for example.

The slidable axial seal 24 permits relative motion between the cold finger assembly 40 and pulse tube expander assembly 41 toward the heat exchanger assembly 42 as the cold finger 12 and regenerator assembly 41 cool down.

The heat exchanger assembly 42 is comprised of an outer heat exchanger housing 22*a* and an axial rejection heat exchanger housing 22*b*. An axially-located rejection heat exchanger 23 is disposed in the axial rejection heat exchanger housing 22*b*. and a primary heat exchanger 28 that abuts an end of the regenerator 17 is disposed in the outer heat exchanger housing 22*a*. The rejection heat exchanger 23 may be comprised of 100 mesh copper screen, for example. The primary heat exchanger 28 may also be comprised of 100 mesh copper screen, for example.

A coolant channel 27 is formed in the heat exchanger assembly 42 between and through the outer heat exchanger housing 22*a* and the axial heat exchanger housing 22*b*, that includes a spiral channel 27 that is coupled between a coolant inlet port 25 and a coolant outlet port 26. A coolant, such as water, for example, is caused to flow through the coolant channel 27 between the coolant inlet port 25 and the coolant outlet port 26.

For laboratory measurements, a pressure transducer is coupled to a port in the axial heat exchanger housing 22*b* that senses pressure in the line between the central pulse tube 18 and the surge volume 33. The outer heat exchanger housing 22*a* has a gas inlet port 31 that is coupled to a circular gas inlet and outlet plenum 32 that couples the operating gas into the the heat exchanger 28, then into the concentric regenerator 17, through the cold end heat exchanger 16, into the central pulse tube 18, through the rejection heat exchanger 23, to the surge volume 33, and then return.

The concentric pulse tube cooler 10 of the present invention may be used in cryogenic refrigerators, infrared detector cooling systems, high temperature superconductor cooling systems, high Q microwave resonators, CMOS electronic cooling systems for computer workstations, and automotive HVAC systems, for example.

Thus there has been described a new and improved pulse tube cooler that employs an improved concentric pulse tube expander having a thermal insulator that separates the pulse tube from the regenerator. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. A concentric pulse tube cooler comprising:

a cold finger assembly disposed at a first end of the concentric pulse tube cooler;

a heat exchanger assembly disposed at a second end of the concentric pulse tube cooler that is coupled to a source of operating gas; and a pulse tube expander assembly comprising:

a housing;

a central pulse tube secured to said housing;

a thermal insulator concentrically disposed around the central pulse tube and secured to said housing;

a regenerator concentrically disposed around the concentric insulation tube;

means for thermally coupling the regenerator to the cold finger assembly; and means for movably securing the pulse tube expander assembly to the heat exchanger assembly to permit motion of the pulse tube expander assembly during cooling.

2. The cooler of claim 1 wherein the securing means comprises:

a slidable axial seal for slidably and sealably securing the pulse tube expander assembly to the heat exchanger assembly to permit relative axial motion between the cold finger and pulse tube expander assemblies and the heat exchanger assembly during cooling of the pulse tube cooler.

3. The cooler of claim 1 wherein the cold finger assembly comprises:

a cold finger; and a cold end heat exchanger that is disposed in an axially extended portion of the cold finger.

4. The cooler of claim 1 wherein the cold end heat exchanger assembly comprises:

a housing;

a rejection heat exchanger disposed in the housing;

a primary heat exchanger disposed in the housing;

cooling means for flowing coolant through the heat exchanger assembly; and gas supply means for coupling operating gas to the pulse tube.

5. The cooler of claim 1 wherein the cold end heat exchanger is comprised of 100 mesh copper screen.

6. The cooler of claim 1 wherein the concentric regenerator is comprised of 400 mesh steel screen.

7. The cooler claim 1 wherein the rejection heat exchanger is comprised of 100 mesh copper screen.

8. The cooler of claim 1 wherein the primary heat exchanger is comprised of 100 mesh copper screen.

9. The cooler of claim 1 wherein the heat exchanger assembly 42 comprises a spiral coolant channel for flowing coolant therethrough.

10. The cooler of claim 1 wherein the slidable axial seal 24 is comprised of a viton O-ring.

11. The cooler of claim 1 wherein the thermal insulator is a plastic insulation tube.

12. The cooler of claim 1 wherein the thermal insulator is a vacuum insulator.

13. The cooler of claim 1 wherein the means for coupling the regenerator to the cold finger assembly is comprised of a plurality of channels disposed from the regenerator through the insulator to the cold finger assembly.

14. A concentric pulse tube cooler comprising:

a cold finger assembly disposed at a first end of the concentric pulse tube cooler comprising:

a cold finger; and a cold end heat exchanger that is disposed in an axially extended portion of the cold finger;

a heat exchanger assembly disposed at a second end of the concentric pulse tube cooler that is coupled to a surge volume, said heat exchanger assembly comprising:

an outer heat exchanger housing;

an axial heat exchanger housing;

an axially-located rejection heat exchanger disposed in the axial heat exchanger housing;

a primary heat exchanger that abuts an end of the regenerator disposed in the outer heat exchanger housing;

a coolant channel formed in the outer heat exchanger housing and the axial heat exchanger housing;

a coolant inlet port and a coolant outlet port 26 coupled to opposite ends of the coolant channel;

a gas inlet port; and a circular gas inlet and outlet plenum coupled to the the gas inlet port for coupling operating gas into the pulse tube; and a pulse tube expander assembly comprising:

a housing;

a central pulse tube secured to the housing;

a thermal insulator concentrically disposed around the central pulse tube that is secured to the housing;

a regenerator concentrically disposed around the concentric insulation tube that is secured to the housing;

a plurality of coupling channels disposed through the insulator that couple the regenerator to the cold finger; and a slidable axial seal for slidably securing the pulse tube expander assembly to the heat exchanger assembly to permit relative axial motion between the cold finger and pulse tube expander assemblies and the heat exchanger assembly during cooling of the pulse tube cooler.

15. The cooler of claim 14 wherein the cold finger is comprised of copper.

16. The cooler of claim 14 wherein the cold end heat exchanger is comprised of 100 mesh copper screen.

17. The cooler of claim 14 wherein the concentric regenerator is comprised of 400 mesh steel screen.

18. The cooler of claim 14 wherein the plurality of cold finger coupling channels are disposed through the insulation tube and the cold finger that couple the regenerator to the cold end heat exchanger.

19. The cooler of claim 14 wherein the rejection heat exchanger is comprised of 100 mesh copper screen.

20. The cooler of claim 14 wherein the primary heat exchanger is comprised of 100 mesh copper screen.

21. The cooler of claim 14 wherein the coolant channel comprises a spiral channel that is coupled between a coolant inlet port and a coolant outlet port.

22. The cooler of claim 14 wherein the slidable axial seal is comprised of a viton O-ring.

23. The cooler of claim 14 wherein the thermal insulator is a plastic insulation tube.

24. The cooler of claim 14 wherein the thermal insulator is a vacuum insulator.

* * * * *